United States Patent [19]

Krause, Jr.

[11] 4,011,995

[45] Mar. 15, 1977

[54] BURNER NOZZLE ASSEMBLY

[75] Inventor: William F. Krause, Jr., Dallas, Tex.

[73] Assignee: Otis Engineering Corporation, Dallas, Tex.

[22] Filed: Apr. 9, 1975

[21] Appl. No.: 566,618

[52] U.S. Cl. ..... 239/404; 239/405; 239/406

[51] Int. Cl.[2] ..... F23D 15/00

[58] Field of Search ..... 239/403, 404, 405, 406

[56] References Cited

UNITED STATES PATENTS

| | | | |
|---|---|---|---|
| 1,023,707 | 4/1912 | Anthony | 239/404 |
| 1,826,776 | 10/1931 | Gunter | 239/403 |
| 3,070,317 | 12/1962 | Hunter et al. | 239/403 |
| 3,747,851 | 7/1973 | Conrad | 239/403 |
| 3,897,007 | 7/1975 | Roy | 239/403 |

FOREIGN PATENTS OR APPLICATIONS

| | | | |
|---|---|---|---|
| 3,062 | 1/1972 | Japan | 239/406 |
| 1,229,403 | 4/1971 | United Kingdom | 239/403 |

*Primary Examiner*—Carroll B. Dority, Jr.
*Attorney, Agent, or Firm*—Warren H. Kintzinger

[57] ABSTRACT

A burner nozzle providing substantially smokeless combustion of inflamable fluids such as petroleum that must be burned off, in a burner system not requiring water spray. A compressed gas, introduced to the inflamable fluid within the nozzle structure acts as an atomization aid, and as an initial combustion sustaining vehicle for the inflamable fluid. The compressed gas is directively introduced within the nozzle so as to, with combined flow from the nozzle, achieve an optimum flame shape and insure clean burning.

8 Claims, 2 Drawing Figures

BURNER NOZZLE ASSEMBLY

Figure 1:
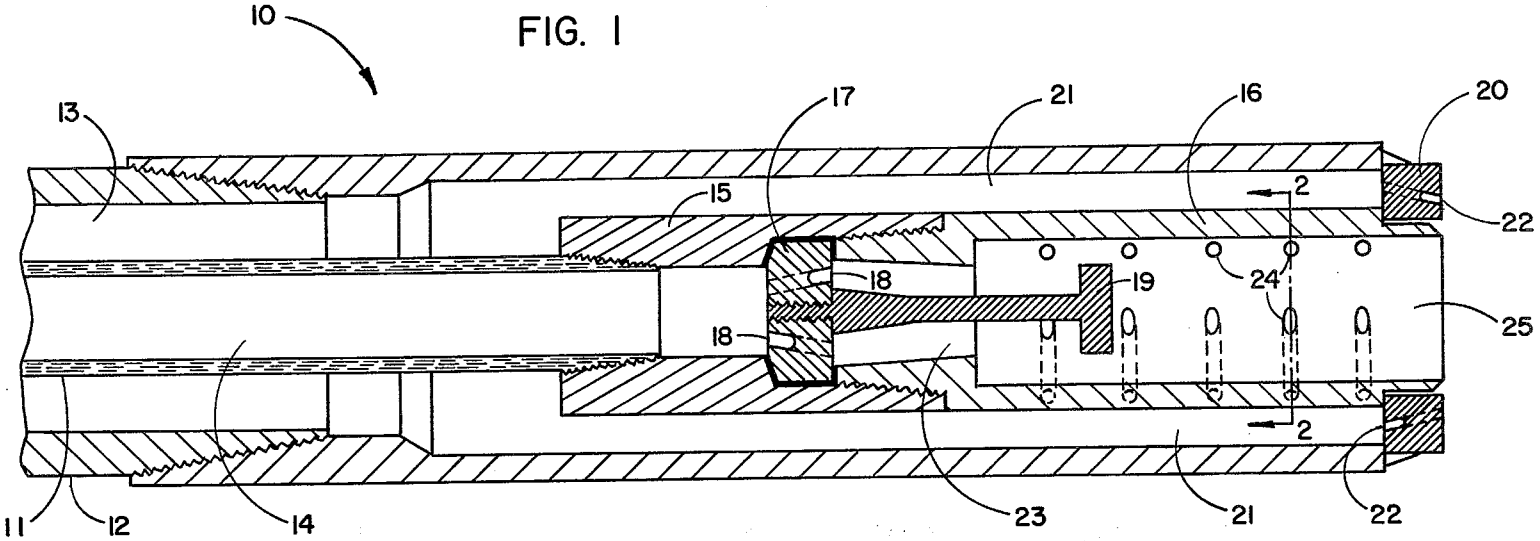

This invention relates in general to the disposal of petroleum base effluents, and in particular, to a burner nozzle assembly for use in combustion disposal of such effluents. In oil well testing, one practice is to burn the oil flowing from the well. In connection with such burning, there are various types of burners presently in use. Ecological considerations and regulatory standards require that the burning of oil be accomplished without forming significant residue or smoke. Many prior art burners satisfy these requirements but, for the most part, require the use of water as an aid in the elimination of smoke. There are many oil producing areas of the world where the use of water in burners is impractical, however. In the desert, for example, the non-availability of water is a significant problem; and in the arctic regions, low ambient temperatures make the use of water a practical impossibility.

It is therefore a principal object of this invention to provide a burner nozzle assembly for the non-polluting combustion of fluid petroleum.

Another object is to provide such a nozzle assembly that uses no water, yet still provides efficient non-polluting combustion.

A further object is to provide a nozzle utilizing compressed air or well gas to atomize the effluent, to support the combustion thereof, and to further shape the flame.

Features of this invention useful in accomplishing the above objects include, a burner nozzle assembly comprising a central core for carrying effluent; an outer annulus for carrying compressed air or well gas; a deflector for the effluent in the core; and openings between the core and the outer annulus, configured to allow entry of the compressed air or well gas into the core, in a swirling manner to atomize the effluent and to shape the flame.

Figure 2:
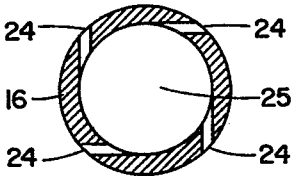

A specific embodiment representing what is presently regarded as the best mode of carrying out the invention is illustrated in the accompanying drawing. In the drawing:

FIG. 1 is a schematic longitudinal sectional view of a burner nozzle assembly constructed in accordance with the principles of this invention; and FIG. 2, a sectional end view of the nozzle assembly of FIG. 1, taken from the section line 2 — 2 of FIG. 1.

Referring to the drawing:

The burner nozzle 10 of FIG. 1 includes a hollow inner body 11 and an outer body 12, forming an annular space therebetween referred to generally as annulus 13. The petroleum effluent to be disposed of by combustion is pumped through the bore 14 of body 11, by means not shown. Compressed air or well gas, at a pressure of approximately 100 p.s.i. is introduced into annulus 13, by means not shown. Tube 11 is connected, as by threads, to an adapter member 15, that is in turn, connected by threading to core member 16. Between, and held by, members 15 and 16 is a moderately thick orifice plate 17 with a plurality of drilled through holes 18. An oil deflector member 19 is mounted in orifice plate 17 to extend forwardly therefrom. Nozzle assembly 10 terminates in an air tip ring member 20 enclosing the forward end of the extension 21 of annulus 13 other than for a plurality of holes 22 through member 20.

The hydrocarbon effluent passes from left to right through bore 14 until it reaches plate 17. The holes 18 in orifice plate 17 are drilled therethrough at compound angles with each hole directed at an angle toward the outside of assembly 10 and also at an angle tangential to the wall of chamber 23. The thickness of orifice plate 17 is sufficient, and holes 18 long enough, to impart a directional flow to the effluent as it exits into chamber 23. Holes 18 are sized to effect the directional change of the effluent without imparting an undue pressure restriction thereto while the combination of the angles of the holes 18 with the thickness of plate 17 causes the effluent to exit in a multijetted swirling manner in chamber 23. The slant of the truncated connical wall defining chamber 23 causes the swirling effluent to follow an inwardly deflected basically helical flow pattern around and along the stem deflector 19 until it strikes the flanged head of deflector 19. With effluent striking the flanged head of deflector 19, a shearing action occurs further breaking up the effluent and causing it to strike the inner surface of core member 16, forming a thin film of the effluent along the inner surface and increase atomization of the effluent.

With reference to the cross sectional view of FIG. 2, core member 16 has a plurality of holes 24 drilled through the wall thereof at angles for inlet gas flow to be tangential to the inner surface thereof. The thin film of effluent adhering to the inner wall surface of core member 16 is then subject to particalizing shear forces by the compressed gas entering through holes 24 from annulus extension 21. The resulting gas-effluent atomized mixture swirls through mixing chamber 25, within core member 16, and exits out the open end of nozzle assembly 10. An ignitor assembly, not shown, initially ignites the gas-effluent mixture as it first leaves the nozzle to start the combustion flame. A plurality of symetrically positioned holes 22 are drilled through air tip ring member 20, each at a compound angle having a component toward the center of the nozzle assembly and also at a component generally tangential to the bore of the nozzle so that compressed gas in annulus extension 21, exiting through holes 22, assists the gas-effluent mixture in swirling as it leaves the nozzle, and also to aid in drawing in secondary air from the surroundings to assist in combustion and to hold air pollution to a minimum.

Although only a single burner nozzle assembly has been shown, it is expressly understood that a plurality of such nozzle assemblies may be combined to form a multi-nozzle burner unit, such as shown, for example, in U.S. Pat. No. 3,797,992.

Whereas this invention is herein illustrated and described with respect to a specific embodiment thereof, it should be realized that various changes could be made without departing from the essential contributions to the art made by the teachings hereof.

I claim:

1. A burner nozzle assembly including: a first hollow elongated body; a second hollow elongated body internal to said first body and spaced from said first body to form an annular space therebetween; said second body having a plurality of openings therethrough near one end thereof providing fluid communication between said annular space and the interior of said second body; a member capping said annular space at said one end; deflector means positioned inside said second body in the vicinity of said openings; a plate member positioned intermediate said first body and said, second body, said plate member having a plurality of openings therethrough, each of said openings being angularly directed tangentially to an internal surface of said second body and outward from said first body to said second body; and said deflector means comprising a stem portion and a flanged head portion mounted on one end of said stem portion, the other end of said stem portion being connected to said plate member.

2. The burner nozzle assembly of claim 1, wherein said capping member has a plurality of openings therethrough.

3. The burner nozzle assembly of claim 1, wherein said second body openings are directed tangentially to the inner surface of said second body.

4. A burner nozzle assembly for mixing a liquid fuel with a combustion supporting gas and discharging the mixture into a flame area including: a first hollow elongated body adapted to carry said fuel; a second hollow elongated body external to and concentric with said first body and spaced therefrom so as to form an annular space therebetween adapted to carry said gas at an elevated pressure; a third hollow body coupled to said first body, said third body being inside said second body and spaced therefrom so as to form an extension of said annular space, said third body having a plurality of openings therethrough for communication of said gas from said annular space extension to the inside of said third body; a plate member positioned intermediate said first body and said third body, said plate member having a plurality of openings therethrough, each of said openings being angularly directed tangentially to an internal surface of said third body and outward from said first body to said third body, whereby a swirling motion is imparted to the fuel as it enters the interior of said body; and a deflector member positioned inside said third body for directing the flow of the fuel to the inner surface of said third body; whereby a mixture of said fuel and said gas is produced.

5. The burner nozzle of claim 4, wherein said third body openings are directed tangentially to the inner surface of said third body, whereby a swirling motion is imparted to the mixture of fuel and gas.

6. The burner nozzle assembly of claim 4, wherein said deflector member comprises a stem portion and a flanged head portion mounted on one end of said stem portion, the other end of said stem portion being connected to said plate member.

7. The burner nozzle assembly of claim 6, wherein the inner surface of said third body is slanted in the vicinity of said stem portion of said deflector member so as to direct the swirling fuel around said stem portion to fuel impact on said flanged head portion of said deflector member.

8. The burner nozzle assembly of claim 4, further comprising a member capping said annular space extension, said capping member having a plurality of openings therethrough, each of said openings being angularly directed tangentially to said third body and inward from said annular space extension, whereby a swirling motion is imparted to the gas as it exits said burner nozzle assembly into said flame area.

* * * * *